United States Patent [19]

Aoki et al.

[11] Patent Number: 4,557,999

[45] Date of Patent: Dec. 10, 1985

[54] SILVER HALIDE COLOR PHOTOGRAPHIC LIGHT-SENSITIVE MATERIAL

[75] Inventors: Kozo Aoki; Akira Ogawa; Osami Tanabe, all of Kanagawa, Japan

[73] Assignee: Fuji Photo Film Co., Ltd., Kanagawa, Japan

[21] Appl. No.: 578,350

[22] Filed: Feb. 9, 1984

[30] Foreign Application Priority Data

Feb. 9, 1983 [JP] Japan ..... 58-20432

[51] Int. Cl.[4] ..... G03C 7/16

[52] U.S. Cl. ..... 430/385; 430/393; 430/505; 430/546; 430/553

[58] Field of Search ..... 430/552, 553, 384, 385, 430/546, 505, 393

[56] References Cited

U.S. PATENT DOCUMENTS 2,772,162 11/1956 Salminen et al. ..... 430/552
3,767,412 10/1973 Monbaliu et al. ..... 430/552

FOREIGN PATENT DOCUMENTS 2098600 11/1982 United Kingdom .

*Primary Examiner*—J. Travis Brown
*Attorney, Agent, or Firm*—Sughrue, Mion, Zinn, Macpeak & Seas

[57] ABSTRACT

A silver halide color photographic light-sensitive material is disclosed. The material is comprised of a support base having thereon a silver halide emulsion layer and a cyan dye forming coupler. The coupler is a compound represented by the general formula (I):

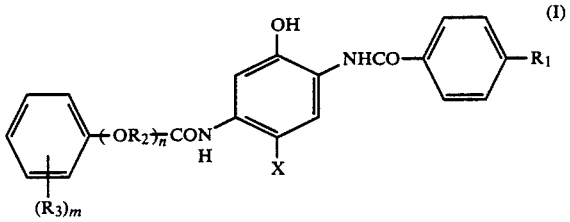

(I)

wherein the substituents in the general formula (I) are as defined in the specification. The coupler has good solubility in an organic solvent having a high boiling point and a high dye forming rate even in a color developing solution which does not contain benzyl alcohol. Further, the coupler provides a cyan color image having a high maximum density and excellent fastness to light. Decreasing in optical density of the cyan color image is not substantially observed even when the color photographic light-sensitive material is processed with a bleaching solution which has a weak oxidation power or a bleaching solution which is exhausted.

18 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing a novel cyan dye forming coupler.

BACKGROUND OF THE INVENTION

When a silver halide photographic light-sensitive material is subjected to color development after being exposed to light, an oxidized aromatic primary amine developing agent reacts with a dye forming coupler to form a dye image. Generally, in this process, a color reproduction process by a subtractive process is used, wherein dye images of yellow, magenta and cyan which are complement colors of blue, green and red are formed in order to reproduce blue, green and red. As the cyan color image forming coupler, a phenol and a naphthol have often been used. However, a color image obtained from using a phenol or a naphthol conventionally employed has many problems in preservability. For example, a color image obtained from a 2-acylaminophenol cyan coupler as described in U.S. Pat. Nos. 2,367,531 and 2,423,730 has generally inferior fastness to heat, a color image obtained from a 2,5-diacylaminophenol cyan coupler as described in U.S. Pat. Nos. 2,369,929 and 2,772,162 has generally inferior fastness to light, and a 1-hydroxy-2-naphthamide cyan coupler is generally insufficient with respect to its fastness to both heat and light.

On the other hand, a 2,5-diacylaminophenol cyan coupler as described in U.S. Pat. No. 4,124,396, Japanese Patent Application (OPI) No. 155538/82 (the term "OPI" as used herein refers to a "published unexamined Japanese patent application") and G.B. 2,098,600A is said to have good fastness and good solubility in an organic solvent having a high boiling point as compared with the above-described conventional cyan couplers. However, such a coupler still has disadvantages in that its fastness is not sufficient for preserving for a long period of time and in that it tends to crystallize when it is added to the photographic emulsion.

SUMMARY OF THE INVENTION

An object of the present invention is to provide a silver halide color photographic light-sensitive material uusing a superior cyan dye forming coupler in which the above-described defects are eliminated and which has good fastness and is easily dissolved in an organic solvent having a high boiling point.

Another object of the present invention is to provide a cyan dye forming coupler having a high dye forming rate in a color developing solution and providing a high maximum color density and, particularly, in a color developing solution free from benzyl alcohol.

A further object of the present invention is to provide a cyan dye forming coupler which does not substantially decrease in optical density when a color photographic light-sensitive material containing the coupler is processed with a bleaching solution which has a weak oxidation power or a bleaching solution which is exhausted.

Other objects of the present invention will become apparent from the following detailed description and examples.

These objects of the present invention have been accomplished by a cyan dye forming coupler represented by the general formula (I) described below and a silver halide color photographic light-sensitive material contaning a cyan dye forming coupler represented by the following general formula (I):

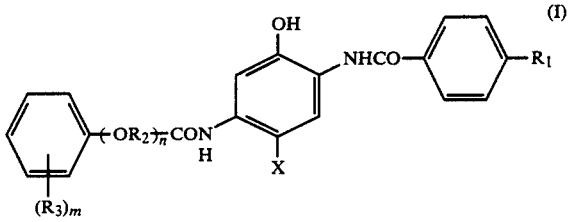

(I)

wherein $R_1$ represents a branched chain alkyl group having from 3 to 4 carbon atoms; $R_2$ represents an alkylene group having from 1 to 21 carbon atoms; $R_3$ represents a hydrogen atom, a halogen atom, a substituted or unsubstituted alkyl group, a substituted or unsubstituted aryl group,

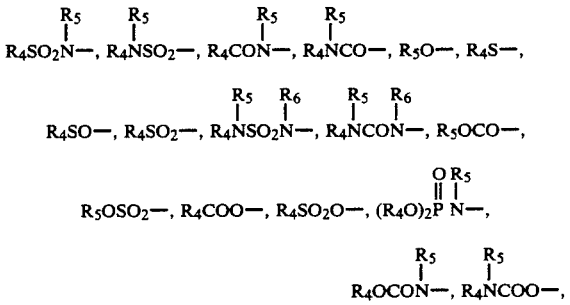

a nitro group or a cyano group; $R_4$ represents a substituted or unsubstituted straight chain, branched chain or cyclic alkyl group, a substituted or unsubstituted aryl group or a heterocyclic group; $R_5$ and $R_6$ each represents a hydrogen atom, a substituted or unsubstituted straight chain, branched chain or cyclic alkyl group, a substituted or unsubstituted aryl group or a substituted or unsubstituted heterocyclic group; n represents 0 or 1; m represents an integer of 1 to 5 and when m represents 2 or more $R_3$s may be the same or different; and X represents a hydrogen atom or a halogen atom.

DETAILED DESCRIPTION OF THE INVENTION

In the following, $R_1$, $R_2$, $R_3$, X, n and m in the general formula (I) above are explained in greater detail.

In the general formula (I), $R_1$ represents a branched chain alkyl group having from 3 to 4 carbon atoms (for example, an isopropyl group, an isobutyl group, a sec-butyl group, a tert-butyl group, etc.).

In the general formula (I), $R_2$ represents an alkylene group having from 1 to 21 carbon atoms (for example, a methylene group, a propylidene group, a propylene group, a pentylidene group, a tridecylene group, etc.).

In the general formula (I), $R_3$ represents a hydrogen atom, a halogen atom (for example, a fluorine atom, a chlorine atom, a bromine atom, etc.), an alkyl group (for example, a methyl group, a propyl group, a tert-amyl group, a pentadecyl group, etc.), an aryl group (for example, a phenyl group, a naphthyl group, etc.), or the groups each represented by the following formulae:

$R_4SO_2\overset{R_5}{\overset{|}{N}}-$, $R_4\overset{R_5}{\overset{|}{N}}SO_2-$, $R_4\overset{R_5}{\overset{|}{C}}ON-$, $R_4\overset{R_5}{\overset{|}{N}}CO-$, $R_5O-$, $R_4S-$, $R_4SO-$, $R_4SO_2-$, $R_4\overset{R_5}{\overset{|}{N}}SO_2\overset{R_6}{\overset{|}{N}}-$, $R_4\overset{R_5}{\overset{|}{N}}CO\overset{R_6}{\overset{|}{N}}-$, $R_5OCO-$, $R_5OSO_2-$, $R_4COO-$, $R_4SO_2O-$, $(R_4O)_2\overset{OR_5}{\overset{\|}{P}}\overset{|}{N}-$, $R_4OCO\overset{R_5}{\overset{|}{N}}-$, $R_4\overset{R_5}{\overset{|}{N}}COO-$, $O_2N-$, $NC-$ wherein $R_4$ represents a straight chain, branched chain or cyclic alkyl group (for example, a methyl group, an isopropyl group, a butyl group, a 2-ethylhexyl group, a cyclohexyl group, a dodecyl group, etc.), an aryl group (for example, a phenyl group, a naphthyl group, etc.) or a heterocyclic group (for example, a 2-pyridyl group, a 2-oxazolyl group, etc.); and $R_5$ and $R_6$ each represents a hydrogen atom, a straight chain, branched chain or cyclic alkyl group, an aryl group or a heterocyclic group. The group represented by $R_3$, $R_4$, $R_5$ and $R_6$ may be substituted with one or more substituents selected from an alkyl group, an aryl group, a heterocyclic group, an alkoxy group (for example, a methoxy group, a dodecyloxy group, a 2-methoxyethoxy group, etc.), an aryloxy group (for example, a phenoxy group, a 2,4-di-tert-amylphenoxy group, a 3-tert-butyl-4-hydroxyphenoxy group, a naphthyloxy group, etc.), a carboxy group, a carbonyl group (for example, an acetyl group, a tetradecanoyl group, a benzoyl group, etc.), an ester group (for example, a methoxycarbonyl group, a phenoxycarbonyl group, an acetoxy group, a benzoyloxy group, a butoxysulfonyl group, a toluenesulfonyloxy group, etc.), an amido group (for example, an acetylamino group, an ethylcarbamoyl group, a methanesulfonylamido group, a butylsulfamoyl group, etc.), an imido group (for example, a succinimido group, etc.), a sulfonyl group (for example, a methanesulfonyl group, etc.), a hydroxy group, a cyano group, a nitro group and a halogen atom.

In the general formula (I), X represents a hydrogen atom or a halogen atom (for example, a fluorine atom, a chlorine atom, a bromine atom, etc.).

In the general formula (I), n represents 0 or 1 and m represents an integer of 1 to 5 and when m represents 2 or more $R_3$s may be the same or different.

Preferred group for $R_1$ in the general formula (I) is an isopropyl group or a tert-butyl group.

Preferred group for $R_2$ in the general formula (I) is an alkylene group having from 1 to 19 carbon atoms (for example, a methylene group, a propylene group, a pentylidene group, a tridecylidene group, etc.) and an alkylidene group having from 3 to 13 carbon atoms is particularly preferred.

Preferred group for $R_3$ is a hydrogen atom, a halogen atom (for example, a fluorine atom, a chlorine atom, a bromine atom, etc.), an alkyl group (for example, a methyl group, a tert-butyl group, a pentadecyl group, a trifluoromethyl group, etc.), $R_4SO_2NH-$, $R_4\overset{R_5}{\overset{|}{N}}SO_2-$, $R_4CONH-$, $R_4\overset{R_5}{\overset{|}{N}}CO-$, $R_5O-$, -continued $R_4\overset{R_5}{\overset{|}{N}}SO_2NH-$, $R_5OCO-$, $O_2N-$ or $NC-$ (wherein $R_4$ and $R_5$ each has the same meaning as defined above).

n is preferably 1 in the general formula (I).

Preferred atoms for X are a hydrogen atom or a chlorine atom. A chlorine atom is particularly preferred for X in the general formula (I).

It is known that specific groups are introduced as substituents (particularly for $R_3$ and X) into a 2,5-diacylaminophenol cyan coupler in order to impart improved color forming properties and fastness. In most cases, however, these couplers have poor solubility and tend to crystallize when they are added to a photographic emulsion. On the contrary, the compounds represented by the above-described general formula (I) (hereinafter referred to as coupler of the present invention) have a branched chain alkyl group on the benzoylamino group at the 2-position of the phenol, and they are characterized by a combination of the branched chain alkyl group for $R_1$ and the groups defined for $R_2$, $R_3$ and X (particularly a hydrogen atom or a halogen atom for X). It is believed that various good characteristics are obtained by the combination of these groups. In British Patent Application No. 2,098,600A, a coupler having a tert-butylbenzoylamino group at the 2-position of a phenol is described. However, the solubility and color forming property of the coupler are not at all excellent as described in an Example hereinafter. Therefore, it is surprising to obtain the excellent effects by the couplers of the present invention.

More specifically, the couplers of the present invention have excellent solubility in an organic solvent having a high boiling point, good dispersion stability in a photographic emulsion, favorable spectral absorption characteristics and excellent transparency. Further, color images obtained from the couplers of the present invention have excellent preservability, namely, excellent fastness to heat and light. The couplers of the present invention are characterized by showing almost no reduction in density when processed with a bleaching solution having a weak oxidation power or a bleaching solution which is exhausted.

The coupler of the present invention is incorporated into an emulsion layer, generally in an amount of from $2\times10^{-3}$ to $5\times10^{-1}$ mol, preferably $1\times10^{-2}$ to $5\times10^{-1}$ mol, per mol of silver.

In the following, typical specific examples of the cyan dye forming couplers included in the scope of the present invention are described, but the couplers according to the present invention are not to be construed as being limited thereto.

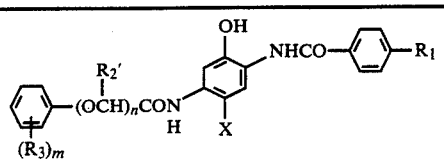

| Coupler No. | $R_1$ | $R_2'$ | n | $(R_3)_m$ | X |
|---|---|---|---|---|---|
| 1 | tert-$C_4H_9$ | $C_2H_5$ | 1 | $C_{15}H_{31}(n)$ | Cl |
| 2 | tert-$C_4H_9$ | $C_2H_5$ | 1 | $C_{15}H_{31}(n)$ | H |
| 3 | tert-$C_4H_9$ | $C_4H_9(n)$ | 1 | $C_{15}H_{31}(n)$ | Cl |
| 4 | tert-$C_4H_9$ | $C_{12}H_{25}(n)$ | 1 | $NHSO_2N(CH_3)_2$ | Cl |
| 5 | tert-$C_4H_9$ | $C_{12}H_{25}(n)$ | 1 | | Cl |
| 6 | tert-$C_4H_9$ | $C_{12}H_{25}(n)$ | 1 | $CH_3$ | Cl |
| 7 | tert-$C_4H_9$ | $C_{12}H_{25}(n)$ | 1 | $NO_2$ | Cl |
| 8 | tert-$C_4H_9$ | $C_2H_5$ | 1 | $C_5H_{11}(t)$, $C_5H_{11}(t)$ | Cl |
| 9 | tert-$C_4H_9$ | — | 0 | $NHCOC_{17}H_{35}(iso)$ | Cl |
| 10 | tert-$C_4H_9$ | $C_{12}H_{25}(n)$ | 1 | OH, $C_4H_9(t)$ | Cl |
| 11 | tert-$C_4H_9$ | $C_{12}H_{25}(n)$ | 1 | CN | Cl |
| 12 | tert-$C_4H_9$ | $C_{12}H_{25}(n)$ | 1 | $COOC_2H_5$ | H |
| 13 | tert-$C_4H_9$ | $C_{12}H_{25}(n)$ | 1 | $CON(C_2H_5)_2$ | Cl |

-continued

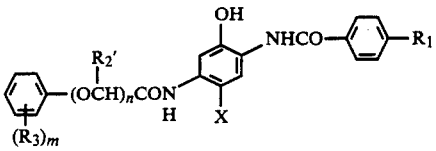

| Coupler No. | $R_1$ | $R_2'$ | n | $(R_3)_m$ | X |
|---|---|---|---|---|---|
| 14 | tert-$C_4H_9$ | $C_2H_5$ | 1 | $OC_8H_{17}(n)$ | Cl |
| 15 | tert-$C_4H_9$ | $C_{12}H_{25}(n)$ | 1 | $CH_3$ | Cl |
| 16 | tert-$C_4H_9$ | $C_{12}H_{25}(n)$ | 1 | $NO_2$, Cl | Cl |
| 17 | tert-$C_4H_9$ | $C_{12}H_{25}(n)$ | 1 | Cl | Cl |
| 18 | tert-$C_4H_9$ | $C_{12}H_{25}(n)$ | 1 | Cl, $CH_3$ | Cl |
| 19 | tert-$C_4H_9$ | $C_{12}H_{25}(n)$ | 1 | $(iso)C_3H_7$ | Cl |
| 20 | iso-$C_3H_7$ | $C_{12}H_{25}(n)$ | 1 | | Cl |
| 21 | iso-$C_3H_7$ | $C_{12}H_{25}(n)$ | 1 | OH, $C_4H_9(t)$ | Cl |
| 22 | iso-$C_3H_7$ | $C_2H_5$ | 1 | $OC_8H_{17}(n)$ | Cl |
| 23 | iso-$C_3H_7$ | $C_{12}H_{25}(n)$ | 1 | F | Cl |
| 24 | iso-$C_3H_7$ | $C_{12}H_{25}(n)$ | 1 | | Cl |
| 25 | tert-$C_4H_9$ | $C_{12}H_{25}(n)$ | 1 | NC | Cl |
| 26 | sec-$C_4H_9$ | $C_{12}H_{25}(n)$ | 1 | Cl | Cl |

-continued

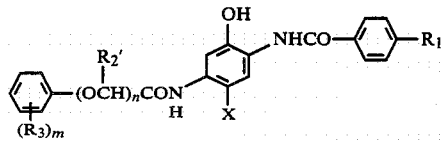

| Coupler No. | $R_1$ | $R_2'$ | n | $(R_3)_m$ | X |
|---|---|---|---|---|---|
| 27 | iso-$C_4H_9$ | $C_{12}H_{25}$(n) | 1 | Cl | Cl |
| 28 | sec-$C_4H_9$ | $C_4H_9$(n) | 1 | $C_{15}H_{31}$(n) | Cl |
| 29 | tert-$C_4H_9$ | $C_{12}H_{25}$(n) | 1 | $CF_3$ | Cl |
| 30 | tert-$C_4H_9$ | $C_4H_9$(n) | 1 | $C_8H_{17}$(t) | Cl |
| 31 | tert-$C_4H_9$ | $C_4H_9$(iso) | 1 | $C_{15}H_{31}$ | Cl |

Representative synthesis examples of the couplers of the present invention are set forth below.

SYNTHESIS EXAMPLE 1

Synthesis of Coupler (1)

396 g of 2-amino-4-chloro-5-nitrophenol was suspended in 2.5 l of acetonitrile to which was added dropwise 418 g of 4-tert-butylbenzoyl chloride over a period of 30 minutes while refluxing by heating. After further refluxing by heating for 1 hour, the reaction mixture was cooled and the crystals thus precipitated were collected by filtration, washed with acetonitrile and dried to obtain 580 g of the crystals (melting point: 242 to 247° C.). The crystals were refluxed by heating for 1 hour together with 466 g of iron powder, 350 ml of water, 2 l of isopropanol and 30 ml of hydrochloric acid. After removing the iron powder by filtration, the crystals thus precipitated were collected by filtration and dried to obtain 480 g of 5-amino-2-(4-tert-butylbenzolyamino)-4-chlorophenol having a melting point of 164° to 165° C.

95.7 g of 5-amino-2-(4-tert-butylbenzoylamino)-4-chlorophenol was added to 770 ml of acetonitrile to which was added dropwise 135 g of 2-(3-pentadecylphenoxy)butanoyl chloride over a period of 1 hour while refluxing by heating. After further refluxing by heating for 2 hours, 1 l of ethyl acetate was added to the reaction mixture and washed with water. The solvent was distilled off under reduced pressure and the residue was crystallized by adding 100 ml of ethyl acetate and 300 ml of n-hexane. By recrystallization 121 g of Coupler (1) having a melting point of 72° to 74° C. was obtained.

Elementary Analysis: Calculated: C, 73.11%, H: 8.46%, N: 4.12%. Found: C: 72.96%, H: 8.50%, N: 4.05%.

SYNTHESIS EXAMPLE 2

Synthesis of Coupler (6)

Using 63.1 g of 5-amino-2-(4-tert-butylbenzoylamino)-4-chlorophenol and 73 g of 2-(3-methylphenoxy)tetradecanoyl chloride, 93 g of Coupler (6) was obtained in the same manner as described in Synthesis Example 1. Melting Point: 119° to 120° C.

Other couplers can be synthesized in the same manner as described above. In the following, the melting points of the representative couplers are set forth.

| Coupler No. | Melting Point (°C.) |
|---|---|
| (4) | 149 to 151 |
| (5) | 107 to 108 |
| (6) | 119 to 120 |
| (7) | 94 to 96 |
| (15) | 157 to 160 |
| (17) | 111 to 113 |
| (18) | 115 to 117 |
| (29) | 145 to 147 |

The photographic emulsion prepared according to the present invention can contain a color image forming coupler other than the coupler of the present invention. Non-diffusible couplers which contain a hydrophobic group referred to as a ballast group in the molecule thereof are preferred as couplers.

Couplers can be 4-equivalent or 2-equivalent with respect to silver ions. In addition, colored couplers providing a color correction effect, or couplers which release a development inhibitor upon development (so-called DIR couplers) can also be present therein. Also, couplers which provide a colorless product on coupling reaction can be employed.

Conventional open chain ketomethylene type couplers can be employed as yellow-color-forming couplers. Of these couplers, benzoylacetanilide type and pivaloylacetanilide type compounds are especially effective. Specific examples of yellow-color-forming couplers which can be employed are described, for example, in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77.

Pyrazolone type compounds, indazolone type compounds, cyanoacetyl compounds, etc., can be employed as magenta-color-forming couplers, and particularly preferred couplers are pyrazolone type compounds. Specific examples of magenta-color-forming couplers which can be employed are those described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78.

Conventional phenol type compounds, naphthol type compounds, etc., can be employed as cyan-color-forming couplers. Specific examples of the conventional cyan-color-forming couplers which can be employed are those described, for example, in U.S. Pat. Nos. 2,369,929, 2,424,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76, 69624/77 and 90932/77.

Colored couplers which can be employed include those described, for example, in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, West German Patent Application (OLS) No. 2,418,959.

DIR couplers which can be employed include those described, for example, in U.S. Pat. Nos. 3,227,554, 3,617,291, 3,701,783, 3,790,384 and 3,632,345, West German Patent Application (OLS) Nos. 2,414,006, 2,454,301 and 2,454,329, British Patent 953,454, Japanese Patent Application (OPI) Nos. 69624/77, 122335/74, Japanese Patent Publication No. 16141/76.

In addition to DIR couplers, other compounds which release development inhibitors upon development can also be present in the light-sensitive material. For example, such DIR compounds as are described in U.S. Pat. Nos. 3,297,445 and 3,379,529, West German Patent Application (OLS) No. 2,417,914, Japanese Patent Application (OPI) Nos. 15271/77 and 9116/78, etc., can be employed.

Two or more kinds of the couplers described above can be incorporated in the same layer, or the same coupler compound can also be present in two or more layers.

Conventional methods, e.g., the method described in U.S. Pat. No. 2,322,027, can be employed to incorporate the couplers into the silver halide emulsion layers. For example, the couplers can be dissolved in an organic solvent having a high boiling point, for example, a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctyl butyl phosphate, etc.), a citric acid ester (e.g., tributyl acetyl citrate, etc.), a benzoic acid ester (e.g., octyl benzoate, etc.), an alkyl amide (e.g., diethyl laurylamide, etc.), a fatty acid ester (e.g., dibutoxyethyl succinate, dioctyl azelate, etc.), a phenol (e.g., 2,4-di-tert-amylphenol, etc.), etc.; or an organic solvent having a boiling point of from about 30° to 150° C., for example, a lower alkyl acetate (e.g., ethyl acetate, butyl acetate, etc.), ethyl propionate, sec-butyl alcohol, methyl isobutyl ketone, $\beta$-ethoxyethyl acetate, methyl Cellosolve acetate, etc. Then, the solution is dispersed in a hydrophilic colloid. The above-described organic solvents having a high boiling point and the above-described organic solvents having a low boiling point may be used as mixtures, if desired.

Furthermore, the dispersing method using a polymeric material as described in Japanese Patent Publication No. 39853/76 and Japanese Patent Application (OPI) No. 59943/76 can also be used.

When couplers having an acid group, such as a carboxylic acid group, a sulfonic acid group, etc., are used, they can be incorporated in a hydrophilic colloid as an alkaline aqueous solution thereof.

The hydrophilic colloid layers of the light-sensitive elements prepared in accordance with the present invention can also contain UV absorbents. For example, benzotriazole compounds substituted with aryl groups (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Application (OPI) No. 2784/71), cinnamic acid ester compounds (e.g., those described in U.S. Pat. Nos. 3,707,375 and 3,705,805), butadiene compounds (e.g., those described in U.S. Pat. No. 4,045,229) or benzoxazole compounds (e.g., those described in U.S. Pat. No. 3,700,455) can be employed. Furthermore, the compounds as described in U.S. Pat. No. 3,499,762, Japanese Patent Application (OPI) No. 485353/79 can also be used. UV absorbing couplers (e.g., $\alpha$-naphthol type cyan-color-forming couplers) and UV absorbing polymers can also be employed. These UV absorbents can also be mordanted in a specific layer(s), if desired.

For the purposes of increasing sensitivity, increasing contrast, or accelerating development, the photographic emulsion layer(s) of the photographic light-sensitive element according to the present invention can contain other compounds, for example, polyalkylene oxides or derivatives thereof such as ethers, esters, amines, etc., thioether compounds, thiomorpholine compounds, quaternary ammonium compounds, urethane derivatives, urea derivatives, imidazole derivatives, 3-pyrazolidones, etc. For example, such compounds as described in U.S. Pat. Nos. 2,400,532, 2,423,549, 2,716,062, 3,617,280, 3,772,021, 3,808,003, British Pat. No. 1,488,991, etc., can be used.

The photographic emulsion of the present invention can also be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

In addition to merocyanine dyes and complex merocyanine dyes, those with nuclei having a ketomethyl structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, and so forth may also be used.

These sensitizing dyes can be employed individually, and can also be employed in combination. A combination of sensitizing dyes is often used, particularly for the purpose of supersensitization.

The hydrophilic colloid layers of the light-sensitive material prepared according to the present invention can contain water-soluble dyes, as filter dyes, for purposes of preventing certain irradiations or other purposes. Such dyes include oxonol dyes, hemioxonol dyes, styryl dyes, merocyanine dyes, cyanine dyes and azo dyes. Of these dyes, oxonol dyes, hemioxonol dyes and merocyanine dyes are especially useful.

The photographic emulsion layers and other hydrophilic colloid layers of the light-sensitive material prepared in accordance with the present invention can contain whitening agents, such as stilbenes, triazines, oxazoles, coumarins, etc. These agents can be water-soluble or can also be employed as a dispersion of water-insoluble whitening agents.

In the practice of the present invention, known color fading preventing agents as described below can be employed. These fading preventing agents can be used individually or in a combination of two or more thereof. Specific examples of known color fading preventing agents include, for example, hydroquinone derivatives as described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921; gallic acid derivatives as described in U.S. Pat. No. 3,457,079 and 3,069,262; p-alkoxyphenols as described in U.S. Pat. Nos. 2,735,765 and 3,698,909, Japanese Patent Publication Nos. 20977/74 and 6623/77; p-oxyphenol derivatives as described in U.S. Pat. Nos. 3,432,300, 3,573,050, 3,574,627 and 3,764,337, Japanese Patent Application (OPI) Nos. 35633/77, 147434/77 and 15225/77; and bisphenol derivatives as described in U.S. Pat. No. 3,700,455, and so forth.

Light-sensitive elements prepared according to the present invention can also contain, as color fog preventing agents, hydroquinone derivatives, aminophenol derivatives, gallic acid derivatives, ascorbic acid derivatives, or the like. Specific examples of these agents are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77, Japanese Patent Publication No. 23813/75, and so forth.

The present invention is also applicable to multilayer multicolor photographic materials containing layers sensitive to at least two different spectral wavelength ranges on a support. A multilayer natural color photographic material generally possesses at least one red-sensitive silver halide emulsion layer, at least one green-sensitive silver halide emulsion layer, and at least one blue-sensitive silver halide emulsion layer, respectively, on a support. The order of these layers can be varied, if desired. Ordinarily, a cyan-forming coupler is present in a red-sensitive emulsion layer, a magenta-forming coupler is present in a green-sensitive emulsion layer, and a yellow-forming coupler is present in a blue-sensitive emulsion layer, respectively. However, if desired, different combinations can be employed.

Known methods can be used for processing the light-sensitive material according to the present invention. Known processing solutions can be used. The processing temperature can be between about 18° C. and about 50° C., in general, but temperatures lower than about 18° C. or higher than about 50° C. may be used, if desired. Either a development processing for forming silver images (black-and-white photographic processing) or a color photographic processing comprising developing processing for forming dye images can be employed, if desired.

The color developer generally comprises an alkaline aqueous solution containing a color developing agent. Suitable color developing agents which can be employed include known primary aromatic amine developing agents, e.g., phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfamidoethylaniline, 4-amino-3-methyl-N-ethyl-N-β-methoxyethylaniline, etc.).

In addition, developing agents described in L. F. A. Mason, *Photographic Processing Chemistry,* at pages 226 to 229, Focal Press (1966), U.S. Pat. Nos. 2,193,015 and 2,592,364, Japanese Patent Application (OPI) No. 64933/73, etc., can be employed.

The color developers can also contain pH buffering agents, such as sulfites, carbonates, borates and phosphates of alkali metals, developing inhibitors or antifogging agents such as bromides, iodides, organic antifogging agents, etc. In addition, if desired, the color developers can also contain water softeners, preservatives such as hydroxylamine; organic solvents such as benzyl alcohol, diethylene glycol, etc.; developing accelerators such as polyethylene glycol, quaternary ammonium salts, amines; dye-forming couplers; competing couplers; fogging agents such as sodium borohydride; auxiliary developing agents such as 1-phenyl-3-pyrazolidone; viscosity imparting agents; polycarboxylic acid type chelating agents as described in U.S. Pat. No. 4,083,723; anti-oxidizing agents as described in West German Patent Application (OLS) No. 2,622,950; and the like.

The photographic emulsion layers after color development are generally bleach-processed. Bleach processing can be performed at the same time as fixing, or separately therefrom.

The present invention is explained in greater detail with reference to the following examples, but the present invention should not be construed as being limited thereto.

EXAMPLE 1

A solution prepared by heating, at 50° C., a mixture of 10 g of Coupler (1) according to the present invention, 10 g of trioctyl phosphate and 20 ml of ethyl acetate was added to 100 ml of an aqueous solution containing 10 g of gelatin and 0.4 g of sodium dodecylbenzenesulfonate with stirring. The mixture was then passed 5 times through a preheated colloid mill, by which the coupler was finely dispersed.

The whole amount of the dispersion thus prepared was added to 400 g of a photographic emulsion containing 21 g of silver iodobromide and 24 g of gelatin and to the mixture, 30 ml of a 2% aqueous solution of 4,6-dichloro-2-hydroxytriazine as a hardener was added. The pH of the mixture was adjusted to 6.0 and coated uniformly on a cellulose triacetate film base. This was designated Sample A.

Using equimolar amounts of Couplers (5) and (7) according to the present invention in place of Coupler (1) described above, films were prepared in the same manner as described above for Sample A. These are designated Samples B and C, respectively.

For comparison, using equimilar amounts of Comparison Couplers (101), (102) and (103) described below in place of Coupler (1) described above, films were prepared in the same manner as described for Sample A. These are designated Samples D, E and F, respectively.

Comparison Coupler (101)

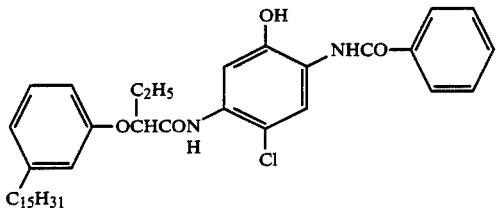

Comparison Coupler (102)

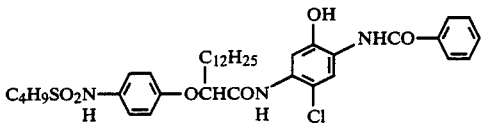

Comparison Coupler (103)

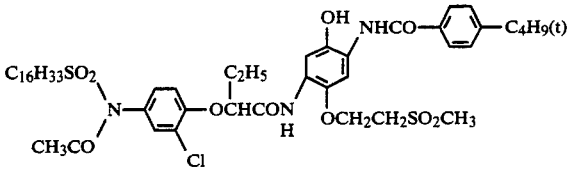

Comparison Coupler (104)

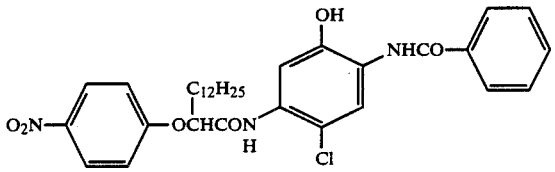

These films were exposed to light using a sensitometric continuous wedge and subjected to the following color development processing.

| Processing Step | Temperature (°C.) | Time |
|---|---|---|
| 1. Color Development | 33 | 3 min 30 sec |
| 2. Bleach-Fixing | 33 | 1 min 30 sec |
| 4. Washing with Water | 25 to 30 | 2 min 30 sec |

Each of the processing solutions used in the color development processing had the following composition.

| Color Developing Solution | |
|---|---|
| Benzyl Alcohol | 15 ml |
| Diethylene Glycol | 8 ml |
| Ethylenediaminetetraacetic Acid | 5 g |
| Sodium Sulfite | 2 g |

-continued

| Color Developing Solution | |
|---|---|
| Anhydrous Potassium Carbonate | 30 g |
| Hydroxylamine Sulfate | 3 g |
| Potassium Bromide | 0.6 g |
| 4-Amino-N—ethyl-N—(β-methanesulfonamido-ethyl)-m-toluidine Sesquisulfate Monohydrate | 5 g |
| Water to make | 1 l (pH 10.2) |

| Beach-Fixing Solution | |
|---|---|
| Ethylenediaminetetraacetic Acid | 2 g |
| Ferric Salt of Ethylenediaminetetra-acetate | 40 g |
| Sodium Sulfite | 5 g |
| Ammonium Thiosulfate | 70 g |
| Water to make | 1 l |

The optical density to red light of each sample thus processed was measured. The results obtained are shown in Table 1 below.

TABLE 1

| Film Sample | Coupler | Gamma | Maximum Density |
|---|---|---|---|
| A | (1) (Present Invention) | 2.67 | 2.38 |
| B | (5) (Present Invention) | 2.73 | 2.51 |
| C | (7) (Present Invention) | 2.74 | 2.53 |
| D | (101) (Comparison) | 2.05 | 1.94 |
| E | (102) (Comparison) | 2.54 | 2.12 |
| F | (103) (Comparison) | 2.58 | 2.20 |

Further, each film thus processed was subjected to examination with respect to fastness. More specifically, the samples were left for 6 days in a dark place at 100° C., the samples were left for 6 weeks in a dark place at 60° C. and 70% RH and the samples were irradiated for 6 days in a xenon test apparatus (100,000 luxes) and a density reduction rate of the sample in the area where the initial density was 1.0 was measured. The results obtained are shown in Table 2 below.

TABLE 2

| Film Sample | Coupler | 100° C. 6 Days | 60° C. 70% RH 6 Weeks | Light (Xenon) 6 Days |
|---|---|---|---|---|
| A | (1) (Present Invention) | 4% | 2% | 22% |
| B | (5) (Present Invention) | 2% | 1% | 21% |
| C | (7) (Present Invention) | 6% | 2% | 25% |
| D | (101) (Comparison) | 9% | 4% | 36% |
| E | (102) (Comparison) | 11% | 5% | 32% |
| F | (103) (Comparison) | 10% | 4% | 33% |

It is apparent from the results shown above that the cyan couplers according to the present invention have excellent color forming properties (i.e., high maximum density and high gamma) and the images formed therefrom have excellent fastness.

Furthermore, the dispersion prepared in the same manner as described above using each of Couplers (1), (5), (7) and (17) according to the present invention and Comparison Couplers (101), (102), (103) and (104) was allowed to stand in a water bath at 40° C. for 4 hours or for 24 hours and then the dispersion was coated on a dry plate. The deposition of crystal with each dry plate was observed using a microscope and the evaluation was carried out using the following classification.

o: Crystals were not observed at all or observed only in a very small amount

Δ: Crystals were observed in a small amount

×: Crystals were observed in a large amount

The results thus obtained are shown in Table 3 below.

TABLE 3

| Coupler | Before Test | After 4 Hours | After 24 Hours |
|---|---|---|---|
| (1) (Present Invention) | o | o | o |
| (5) (Present Invention) | o | o | o |
| (7) (Present Invention) | o | o | o |
| (17) (Present Invention) | o | o | o |
| (101) (Comparison) | o | Δ | x |
| (102) (Comparison) | o | x | x |
| (103) (Comparison) | o | Δ | x |
| (104) (Comparison) | x | x | x |

It is apparent from the results shown in Table 3 above that the couplers of the present invention are advantageous in view of no deposition of the crystals thereof in the dispersion for mixing with a photographic emulsion.

The more unstable the dispersion of the coupler is, the greater the amount of coupler deposited and thus the preservation of the photographic light-sensitive material is adversely affected. The couplers of the present invention are advantageous in view of the preservation of the photographic light-sensitive material.

EXAMPLE 2

On a cellulose triacetate support were coated a first layer (undermost layer) to a sixth layer (uppermost layer) as shown in Table 4 below in order to prepare a multilayer color photographic light-sensitive material which is designated Sample G. In Table 4 below, coating amounts are set forth in mg/m$^2$.

TABLE 4

| | | |
|---|---|---|
| Sixth Layer: (protective layer) | Gelatin | (750 mg/m$^2$) |
| Fifth Layer: (green-sensitive layer) | Silver chlorobromide emulsion (silver bromide: | 30 mol % |
| | silver: | (500 mg/m$^2$) |
| | Gelatin | (1,300 mg/m$^2$) |
| | Magenta coupler *1 | (600 mg/m$^2$) |
| | Coupler solvent *2 | (110 mg/m$^2$) |
| Fourth Layer: | Gelatin | (500 mg/m$^2$) |
| Third Layer: (red-sensitive layer) | Silver chlorobromide emulsion (silver bromide: | 30 mol % |
| | silver: | (500 mg/m$^2$) |
| | Gelatin | (2,900 mg/m$^2$) |
| | Cyan coupler *3 | (1,500 mg/m$^2$) |
| | Coupler solvent *4 | (700 mg/m$^2$) |
| Second Layer: | Gelatin | (500 mg/m$^2$) |
| First Layer: (blue-sensitive layer) | Silver iodobromide emulsion (silver iodide: | 0.2 mol % |
| | silver: | (100 mg/m$^2$) |
| | Gelatin | (2,200 mg/m$^2$) |
| | Yellow coupler *5 | (1,200 mg/m$^2$) |
| | Coupler solvent *6 | (600 mg/m$^2$) |
| Support | Cellulose triacetate | |

*1 Magenta coupler: 3-(2-Chloro-5-tetradecanamidoanilino)-1-(2,4,6-trichlorophenyl)-2-pyrazolin-5-one

*2 Coupler solvent: Tricresyl phosphate

*3 Cyan coupler: 2-(4-Tert-butylbenzamido)-4-chloro-5-[α-(3-pentadecylphenoxy)-butanamido]phenol (i.e., Coupler (1) of the present invention)

*4 Coupler solvent: Dibutyl phthalate

*5 Yellow coupler: α-(4-Methoxybenzoyl)-α-(3-benzyl-4-ethoxyhydantoin-1-yl)-2-chloro-5-dodecyloxycarbonylacetanilide

*6 Coupler solvent: Dibutyl phthalate

For comparison, using an equimolar amount of Comparison Coupler (101) in place of the cyan coupler used in the third layer of Sample G described above, Sample H was prepared in the same manner as described for Sample G.

Each sample was exposed to blue light, green light and red light through a continuous wedge and subjected to the following color development processing.

| Processing Step | Temperature (°C.) | Time |
|---|---|---|
| Color Development | 36 | 3 min |
| Stopping | 25–30 | 40 sec |
| First Fixing | 25–30 | 40 sec |
| Bleaching | 25–30 | 1 min |
| Second Fixing | 25–30 | 40 sec |
| Washing with Water | 25–30 | 30 sec |

Each of the processing solutions used in the color development processing had the following composition:

| | |
|---|---|
| Color Developing Solution | |
| Sodium Sulfite | 5.0 g |
| 4-Amino-3-methyl-N,N—diethylaniline | 3.0 g |
| Sodium Carbonate | 20.0 g |
| Potassium Bromide | 2.0 g |
| Water to make | 1 l |
| | (pH: 10.5) |
| Stopping Solution | |
| 6 N Sulfuric Acid | 50.0 ml |
| Water to make | 1 l |
| | (pH: 1.0) |
| Fixing Solution | |
| Ammonium Thiosulfate | 60.0 g |
| Sodium Sulfite | 2.0 g |
| Sodium Hydrogensulfite | 10.0 g |
| Water to make | 1 l |
| | (pH: 5.8) |
| Bleaching Solution | |
| Potassium Ferricyanide | 30.0 g |
| Potassium Bromide | 15.0 g |
| Water to make | 1 l |
| | (pH: 6.5) |

The optical density at the portion exposed to red light in each sample after development processing was measured. The results obtained are shown in Table 5 below.

TABLE 5

| Film Sample | Coupler | Gamma | Maximum Density |
|---|---|---|---|
| G | (1) (Present Invention) | 4.09 | 3.81 |
| H | (101) (Comparison) | 3.90 | 3.62 |

Further, each film thus processed was subjected to examination with respect to fastness. More specifically, the samples were left for 3 days in a dark place at 100° C., the samples were left for 6 weeks in a dark place at 60° C. and 70% RH and the samples were irradiated for 7 days in a xenon test apparatus (20,000 luxes) and a density reduction rate of the sample in the area where the initial density was 1.0 was measured. The results obtained are shown in Table 6 below.

TABLE 6

| Film Sample | Coupler | 100° C. 3 Days (%) | 60° C. 70% RH 6 Weeks (%) | Light (Xenon) 7 Days (%) |
|---|---|---|---|---|
| G | (1) (Present Invention) | 7 | 2 | 8 |
| G | (101) (Comparison) | 12 | 4 | 13 |

It is apparent from the results shown above that the cyan coupler according to the present invention has excellent color forming properties (i.e., high maximum density and high gamma) and the images formed therefrom have excellent fastness.

EXAMPLE 3

Sample I was prepared in the same manner as described for Sample G except using an equimolar amount of Coupler (17) according to the present invention in place of Coupler (1) according to the present invention as the cyan coupler *3 and using 2,4-di-tert-amylphenol as the coupler solvent *4.

This sample was exposed to blue light, green light and red light through a continuous wedge and subjected to the same color development processing as described in Example 2.

The absorption spectrum of the sample thus processed was measured and the absorption maximum was 660 mμ which was preferred in view of the color reproduction in color photography. Also, the optical density to red light with this sample was measured and the results shown in Table 7 below were obtained.

TABLE 7

| Film Sample | Coupler | Gamma | Maximum Density |
|---|---|---|---|
| I | (17) (Present Invention) | 4.12 | 3.91 |

It is apparent from the results shown in Table 7 above that the cyan coupler according to the present invention has excellent color forming properties and in addition has the preferred absorption characteristics.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a silver halide emulsion layer, the color photographic light-sensitive material containing a cyan dye forming coupler represented by the following general formula (I):

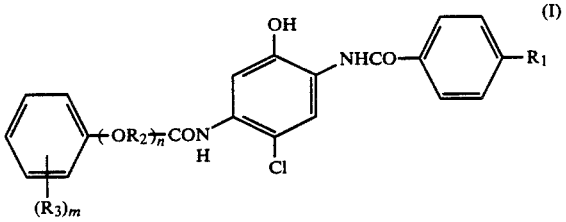

(I)

wherein $R_1$ represents a branched chain alkyl group having from 3 to 4 carbon atoms; $R_2$ represents an alkylene group having from 1 to 21 carbon atoms; $R_3$ represents a hydrogen atom, a halogen atom, a substituted or unsubstituted alkyl group, a substituted or unsubstituted aryl group, $R_4SO_2\overset{R_5}{N}-$, $R_4\overset{R_5}{N}SO_2-$, $R_4CO\overset{R_5}{N}-$, $R_4\overset{R_5}{N}CO-$, $R_5O-$, $R_4S-$, $R_4SO-$, $R_4SO_2-$, $R_4\overset{R_5}{N}SO_2\overset{R_6}{N}-$, $R_4\overset{R_5}{N}CO\overset{R_6}{N}-$, $R_5OCO-$, -continued $R_5OSO_2-$, $R_4COO-$, $R_4SO_2O-$, $(R_4O)_2\overset{O}{\overset{\|}{P}}\overset{R_5}{\overset{|}{N}}-$, $R_4OCO\overset{R_5}{\overset{|}{N}}-$, $R_4\overset{R_5}{\overset{|}{N}}COO-$, a nitro group or a cyano group; $R_4$ represents a substituted or unsubstituted straight chain, branched chain or cyclic alkyl group, a substituted or unsubstituted aryl group or a heterocyclic group; $R_5$ and $R_6$ each represents a hydrogen atom, a substituted or unsubstituted straight chain, branched chain or cyclic alkyl group, a substituted or unsubstituted aryl group or a substituted or unsubstituted heterocyclic group; n represents 0 or 1; and m represents an integer of 1 to 5 and when m represents 2 or more $R_3$s may be the same or different.

2. A silver halide color photographic light-sensitive material as claimed in claim 1, wherein the substituent for the alkyl group, the aryl group and the heterocyclic group represented by $R_3$, $R_4$, $R_5$ or $R_6$ is selected from an alkyl group, an aryl group, a heterocyclic group, an alkoxy group, an aryloxy group, a carboxy group, a carbonyl group, an ester group, an amido group, an imido group, a sulfonyl group, a hydroxy group, a cyano group, a nitro group and a halogen atom.

3. A silver halide color photographic light-sensitive material as claimed in claim 1, wherein the branched chain alkyl group represented by $R_1$ is an isopropyl group or a tert-butyl group.

4. A silver halide color photographic light-sensitive material as claimed in claim 1, wherein the alkylene group represented by $R_2$ is an alkylene group having from 1 to 19 carbon atoms.

5. A silver halide color photographic light-sensitive material as claimed in claim 1, wherein the alkylene group represented by $R_2$ is an alkylidene group having from 3 to 13 carbon atoms.

6. A silver halide color photographic light-sensitive material as claimed in claim 1, wherein $R_3$ represents a hydrogen atom, a halogen atom, an alkyl group, $R_4SO_2NH-$, $R_4\overset{R_5}{N}SO_2-$, $R_4CONH-$, $R_4\overset{R_5}{N}CO-$, $R_5O-$, $R_4\overset{R_5}{N}SO_2NH-$, $R_5OCO-$, $O_2N-$ or $NC-$ wherein $R_4$ and $R_5$ each has the same meaning as defined in claim 1.

7. A silver halide color photographic light-sensitive material as claimed in claim 1, wherein n is 1.

8. A silver halide color photographic light-sensitive material as claimed in claim 1, wherein the cyan dye forming coupler is present in a silver halide emulsion layer.

9. A silver halide color photographic light-sensitive material as claimed in claim 8, wherein the silver halide emulsion layer is a red-sensitive silver halide emulsion layer.

10. A silver halide color photographic light-sensitive material as claimed in claim 8, wherein the cyan dye forming coupler is present in an amount of from $2\times10^{-3}$ mol to $5\times10^{-1}$ mol per mol of silver in the silver halide emulsion layer.

11. A silver halide color photographic light-sensitive material as claimed in claim 9, wherein the photographic material further includes a blue-sensitive silver halide emulsion layer and a green-sensitive silver halide emulsion layer.

12. A silver halide color photographic light-sensitive material as claimed in claim 11, wherein the blue-sensitive silver halide emulsion layer contains a yellow color forming coupler and the green-sensitive silver halide emulsion layer contains a magenta color forming coupler.

13. A silver halide color photographic light-sensitive material as claimed in claim 8, wherein the cyan dye forming coupler is dispersed together with an organic solvent having a high boiling point in a hydrophilic colloid of the silver halide emulsion layer.

14. A method for forming a color image comprising developing an imagewise exposed silver halide color photographic light-sensitive material comprising a support having thereon a silver halide emulsion layer, the color photographic light-sensitive material containing a cyan dye forming coupler represented by the following general formula (I):

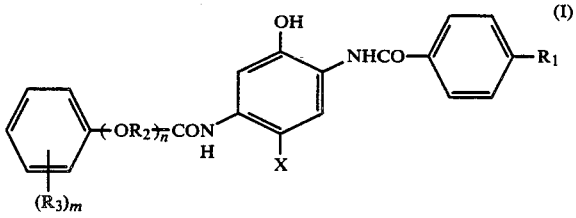

(I)

wherein $R_1$ represents a branched chain alkyl group having from 3 to 4 carbon atoms; $R_2$ represents an alkylene group having from 1 to 21 carbon atoms; $R_3$ represents a hydrogen atom, a halogen atom, a substituted or unsubstituted alkyl group, a substituted or unsubstituted aryl group,

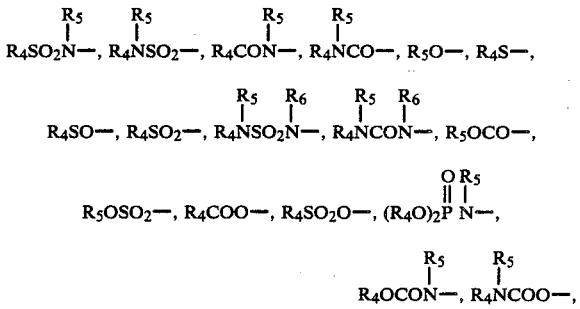

a nitro group or a cyano group; $R_4$ represents a substituted or unsubstituted straight chain, branched chain or cyclic alkyl group, a substituted or unsubstituted aryl group or a heterocyclic group; $R_5$ and $R_6$ each represents a hydrogen atom, a substituted or unsubstituted straight chain, branched chain or cyclic alkyl group, a substituted or unsubstituted aryl group or a substituted or unsubstituted heterocyclic group; n represents 0 or 1; m represents an integer of 1 to 5 and when m represents 2 or more $R_3$s may be the same or different; and X represents a halogen atom; with an alkaline aqueous developing solution containing a primary aromatic amine developing agent.

15. A method of forming a color image as claimed in claim 14, wherein the photographic material, after development, is subjected to processing in a bleach-fixing solution.

16. A method of forming a color image as claimed in claim 15, wherein the bleach-fixing solution contains an ethylenediaminetetraacetate iron (III) complex.

17. A method of forming a color image as claimed in claim 14, wherein the alkaline aqueous developing solution is free from benzyl alcohol.

18. A silver halide color photographic light-sensitive material as claimed in claim 10, wherein the cyan dye forming coupler is present in an amount in the range of $1\times10^{-2}$ to $5\times10^{-1}$ mol per mol of silver.

* * * * *